United States Patent [19]

Vatant

[11] Patent Number: 4,765,392

[45] Date of Patent: Aug. 23, 1988

[54] CONTINUOUS METAL CASTING PLANT

[75] Inventor: Robert Vatant, St-Chamond, France

[73] Assignee: Clecim, Courbevoie, Cedex, France

[21] Appl. No.: 23,745

[22] Filed: Mar. 9, 1987

[30] Foreign Application Priority Data

Mar. 7, 1986 [FR] France ..... 86 03282

[51] Int. Cl.[4] ..... B22D 11/04

[52] U.S. Cl. ..... 164/416; 164/478

[58] Field of Search ..... 164/416, 478

[56] References Cited

U.S. PATENT DOCUMENTS 3,040,397 6/1962 Haussner et al. ..... 164/416 X 3,664,409 5/1972 Kolomeitseu et al. ..... 164/416

4,483,385 11/1984 Kurzinski ..... 164/416

*Primary Examiner*—Kuang Y. Lin

*Attorney, Agent, or Firm*—Pollock, Vande Sande & Priddy

[57] ABSTRACT

A continuous metal casting plant comprising, on a stationary supporting structure (3), an ingot mold (1) and a secondary cooling device (2), apparatus for supporting and guiding the ingot mold permitting oscillations of the latter parallel to its axis and oscillation controls (5) for the ingot mold (1) resting directly on one side on the ingot mold frame (12) and on the other side on the upper part of the frame of the secondary cooling device (2). The invention relates in particular to continuous steel casting.

20 Claims, 4 Drawing Sheets

CONTINUOUS METAL CASTING PLANT

FIELD OF THE INVENTION

The invention relates to a plant for continuous casting of metal and especially steel.

BACKGROUND OF THE INVENTION

Plants of this kind have been known for a long time and, as a general rule, comprise an ingot mold and a secondary cooling device, on a stationary supporting structure, aligned along a casting axis.

The ingot mold consists of a set of walls which are cooled by circulating fluid, which define a bottomless casting cavity and are mounted on a frame-shaped casing which is sufficiently rigid to maintain the positioning of the walls in an accurate manner, it being possible for the latter to be moved, if desired, in order to regulate the dimensions of the casting cavity.

The secondary cooling device itself consists of a set of guiding and cooling devices, generally guiding rolls or plates associated with racks for spraying water, the whole being mounted on a supporting frame and thus defining a passageway placed in the extension of the ingot mold along the casting axis and sometimes known as a "roller apron".

The steel cast into the ingot mold cavity forms, along the cooled walls of the latter, a crust whose thickness increases downwards and which is removed through the opposite end of the cavity, while the cast product, consisting of a liquid core enclosed in the solidified crust, then passes into the guiding jacket whose upper part is placed close to the exit of the ingot mold. The cooling continues inside the guiding jacket whose lower part opens out into a device for extracting the product. The casting may be carried out vertically or in a curved manner, with the roller apron returning to the horizontal the product which is cast vertically.

To enable the product to be readily removed from the ingot mold, the solidified crust must not adhere to the cooled walls and, for this reason, a slight oscillating motion parallel to the axis of casting is applied to the ingot mold. For this purpose, the ingot mold is carried by supporting and guiding members which permit oscillations parallel to the casting axis and are associated with means for controlling oscillations whose amplitude and frequency can be regulated as needed. Since the product is continuous and travels at a substantially constant speed in the roller apron, at each period of oscillating motion, the ingot mold first descends at a speed in relation to that of the product (sinusoidal relationship) down to a certain level, and then rises again to the initial level, while the walls then separate from the product held by the roller apron. To produce this separation, the supporting and oscillating members need therefore to exert a certain force on the ingot mold.

In addition, while continuous casting technology was initially developed for the manufacture of products of relatively small cross-section, it has rapidly been extended to much more substantial plants since, at the present time, slabs more than 2 meters in width and with a thickness of more than 300 mm are being cast continuously. In such cases, the ingot mold reaches a considerable size and weight and the supporting, guiding and oscillation control members must be designed accordingly. In addition, the ingot mold is a sensitive member which must be set accurately and which may be damaged by breakouts of metal, and for this reason it must be capable of being readily taken out of the plant for maintenance or adjustment, or else to be replaced.

It has therefore become customary to make the ingot mold in the form of a separate member which can be fastened removably on a support which is generally plane and is consequently known as the oscillating table, the latter being permanently fastened to the supporting and guiding means which are fastened in places to the plant structure, generally consisting of a metal framework resting on a massive concrete block.

To provide the required degree of freedom when oscillation guidance is provided, a supporting and oscillating lever, which normally comprises two arms placed on each side of the ingot mold, may be connected to the oscillating table by means of two connecting rods articulated, on one side, to the table and, on the other side, to each of the two arms. However, the two arms of the lever may also be articulated directly to the oscillating table, the latter being held by two other connecting rods oriented in directions which are substantially parallel to the two arms of the lever, the precise orientation being determined so that the travel of the ingot mold takes place along the casting axis. The lever and the holding connecting rods are articulated to bearings carried by components which form supporting seats which are placed on and fastened to a stationary platform.

The lever is driven in a reciprocating motion by an oscillation control mechanism which, in most cases, is an eccentric mechanism mounted on the supporting structure at a point which is relatively far from the ingot mold, below the working deck. The forces due to the weight of the ingot mold and to the separation effect, which may be amplified by the levers, are fairly considerable and are absorbed by the bearings of the articulation pivots. These members, generally, are therefore heavy and costly and are subject to relatively high wear because of the high freqency of the oscillating motions and of the applied loads.

SUMMARY OF THE INVENTION

The object of the invention is an arrangement permitting the mechanisms to be considerably simplified and the loads applied to be reduced in order to render the whole assembly less costly and its maintenance easier.

In accordance with the invention, the means for controlling the oscillations of the ingot mold rest directly, on one side on the ingot mold casing and, on the other side, on the upper part of the frame supporting the roller apron.

In view of the fragility of the solidified crust at the exit of the ingot mold, the upper part of the guiding jacket generally consists of a cooling member constructed in a particular way and forming an upper cage which may be readily disassembled from the remainder of the roller apron for maintenance, repair of quick replacement by an exchange cage, since the dangers of breakouts and, consequently, of damages are greater in this region. In particular, since the ingot mold is normally placed at the level of a working floor which covers the plant assembly below, it is advantageous to have the possibility of simultaneous withdrawal of the ingot mold and of the upper member of the roller apron which is placed immediately below the latter, whereas any needed replacement of the remaining parts of the roller apron, which is carried out less often, may be performed in a different manner.

In addition, particular care must be exercised in ensuring the alignment of the ingot mold which is driven with oscillating motions with the cooling cage which follows it and which is stationary itself. It is advantageous to perform this alignment at a location away from the plant so as to make it possible to replace the assembly consisting of the ingot mold and of the upper cage with another assembly which is prepared beforehand. For this purpose, the upper cooling member, which is mounted removably on the structure of the plant, is equipped with fastening means which are removable with the ingot mold, and with means for hooking onto a lifting beam which makes it possible to remove the upper member at the same time as the ingot mold which then rests on the latter. The adjustment of the relative position of both members is performed in an auxiliary gantry and then the assembly is placed back in position, with the ingot mold placed on the upper member coming to rest first on the oscillating table which has been left stationary, and with the upper member continuing its descent as far as supporting members provided on the stationary structure.

In order to make use of this maintenance and replacement method, it has been necessary to strengthen the frame of the upper member of the roller apron, which is then used as a means for transportation of the ingot mold. The invention makes advantageous use of this particular arrangement and this strengthening of the upper part of the roller apron. In point of fact, according to a particularly advantageous feature, the means for controlling the oscillations is fastened, on one side to the ingot mold box and, on the other side, to the frame of the upper cooling member.

According to another preferred feature, the means for controlling oscillations is a hydraulic, preferably double-action, jack comprising a body and a plunger which are connected, respectively, by at least two articulated couplings, one to the ingot mold box and the other to the frame of the upper part of the guiding jacket.

This jack may advantageously itself form the member supporting the ingot mold, which must merely be kept on its trajectory by means of guiding members. The latter are not subjected to the forces due to the weight of the ingot mold and to the separation of the solidified crust, and may consist of slides or, alternately, connecting rods articulated to a supporting component which, according to an additional feature of the invention, may be fastened directly to the frame of the upper cooling cage.

In this case, the ingot mold and its means of support, of guidance and of oscillation control form, together with the upper cooling member, a compact and homogeneous assembly capable of being removed and refitted as a unit and on which the alignment and oscillation amplitude settings may be performed outside the plant and may be maintained with all required precision during operation.

BRIEF DESCRIPTION OF THE DRAWINGS

The invention offers other advantages will be better understood from the following description of certain particular embodiments, which are given by way of example and are illustrated by the attached drawings.

DESCRIPTION OF PREFERRED EMBODIMENT

Figure 1:
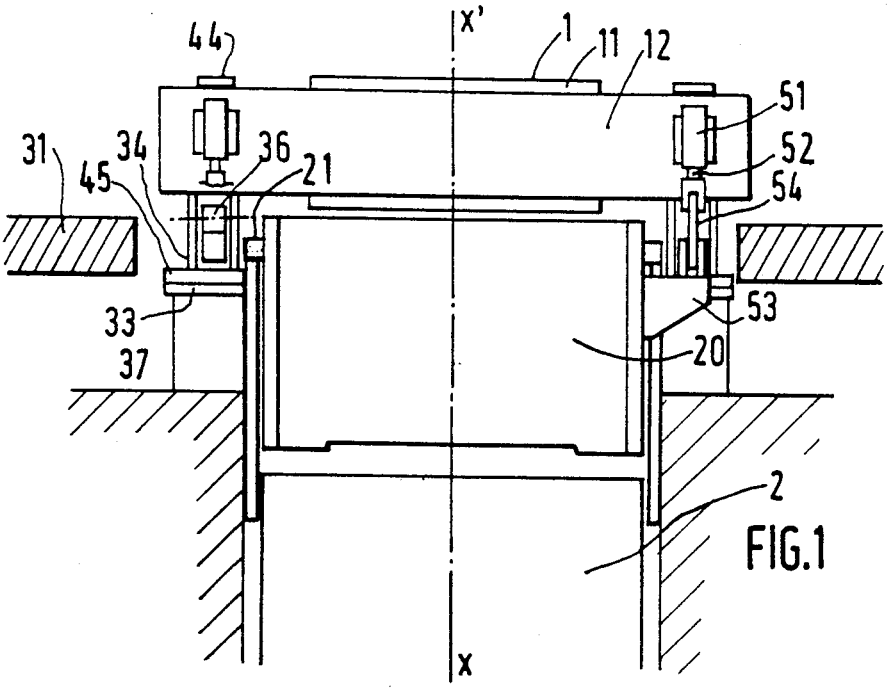
FIG. 1 is a diagrammatic front view of the upper part of a casting plant according to the invention.
Figure 2:
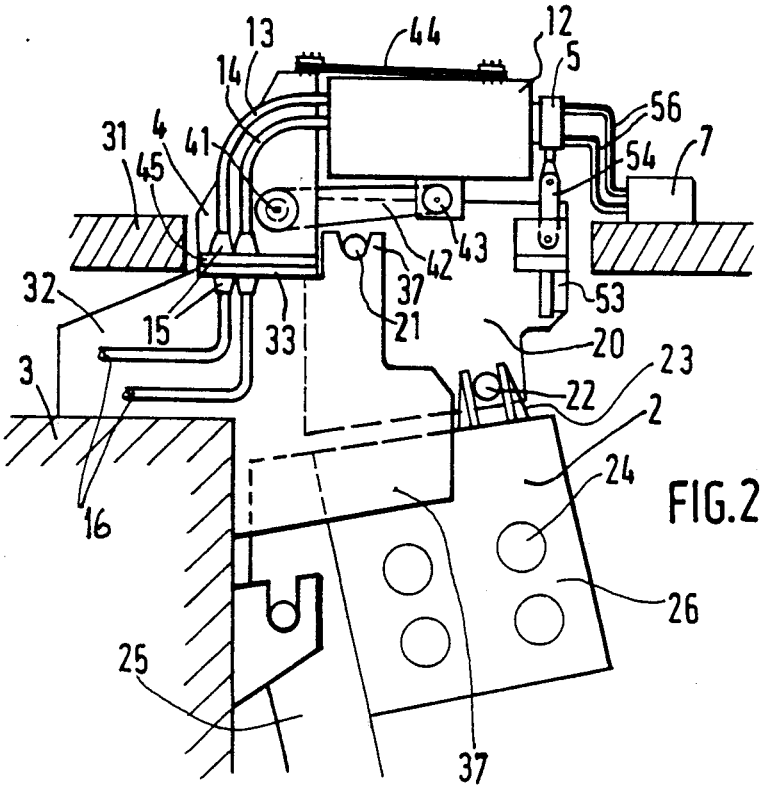
FIG. 2 is a side view of the plant in FIG. 1.

FIGS. 1 and 2 show the upper part of a continuous casting plant comprising an ingot mold 1 and a secondary cooling device 2 forming a roller apron whose upper part at leasts consists of a separate cage 20.

The ingot mold 1 consists of a bottomless mold forming a casting cavity bounded by cooled walls 11 carried by a casing 12.

The whole plant, which, being well known, has been shown only diagrammatically in FIG. 1, is carried by a supporting framework or a massive concrete block 3 and is situated below a working deck 31, with only the ingot mold 1 projecting above the latter.

The roller apron 2 conventionally comprises two series of guiding rolls 24 placed on each side of the product and associated with spraying racks (not shown) mounted on a supporting structure 25. The rolls 24 may be arranged in sections, each comprising a frame 26 supporting several pairs of rolls and mounted removably on the structure 25.

Also in a known manner, the latter rests on the massive foundation block 3 in a manner which allows it to expand.

In the example shown, the ingot mold 1 and the upper cage 20 are carried by a stationary platform 33 arranged in the upper part of the massive foundation block 3, below the level of the casting floor 31, and to which the means for supporting and guiding the ingot mold are fastened, in a removable manner if desired.

Various devices may be employed, in a known manner, to provide the ingot mold with support and guidance.

However, as already indicated, in conventional plants the ingot mold is fastened to a table which is supported by a lever articulated around a stationary horizontal pivot and connected to an oscillating mechanism.

In the plant according to the invention, on the contrary, the oscillating table can be eliminated. In fact, the oscillating motion is produced by one or two hydraulic jacks 5 whose body 51 is fastened rigidly directly to the ingot mold box 12, while the rod of each jack rests directly on the frame of the upper cage 20 by means of a connecting rod 54. Since the upper cage 20 itself rests directly on the supporting structure, the weight of the ingot mold is carried by the oscillation jacks 5. As a result of this, the ingot mold needs merely to be guided in its oscillatory motion and, in the example shown, use is made for this purpose of a pair of connecting rods 42 which are placed on both sides of the box, below the latter, and which are articulated around a pivot 43 on the casing 12 and around a pivot 41, respectively, on two bearing brackets 4, comprising a support plate 45 which may be applied on a horizontal platform 33 provided in the upper part of the massive foundation block 3. In a known manner, supply lines 13 and discharge lines 14 of cooling fluid are connected to stationary circuits 16 by means of removable and leakproof connecting members 15 comprising two parts fastened, respectively, to the support plates 45 and to the platform 33 and which engage into each other when the supporting brackets 4 are applied to the platform 33. In order to be held in a vertical position, the ingot mold casing 12 needs to be supported by a second pair of supporting connecting rods which are articulated to the supporting bracket 4 and to the box 12. According to a particular embodiment, the second pair of supporting connecting rods may be replaced by flexible blades 44 whose ends are fastened to the supporting brackets 4 and to the casing 12, on both sides of the latter, and this makes the assembly still lighter in weight.

In the example shown, the upper member 20 of the roller apron rests separately on the supporting structure. For example, when the platform 33 is provided on a stationary frame 32, the latter can carry bifurcated supporting members 37 placed on each side of the upper member 20 and in which are placed spindles 21 fastened on both sides of the frame 27 of the cage 20. To ensure that guidance is continuous, the lower part of the cage is equipped with two other spindles 22 which slide in guides 23 arranged in the upper part of the roller apron, either directly on the supporting structure or preferably on the frame 26 supporting the rolls of the part of the roller apron following the upper cage 20. Thus, after the support plates 45 have been released from the platform 33, it becomes possible, using slings (not shown), to remove upwards the upper cage 20 which is applied on the ingot mold casing 12. When lifted, the ingot mold rests on the cage 20 and it is possible to lift simultaneously the ingot mold with its casing, the oscillation jack 5 and the guiding means with their supporting brackets 4, the whole being carried by the upper cage 20.

It can be seen, therefore, that the arrangements according to the invention make it possible to remove as a unit not only the ingot mold and the upper member 20 but also all the means of support, of guidance and of oscillation control. As a result, all the members which take part in the oscillation of the ingot mold can be accurately adjusted in a workshop, as also can the amplitude of the oscillating motions controlled by the jack 5.

When the whole assembly is placed back in the plant, the support plates 45 are applied on the supporting platform 33, and then the upper cage 20, together with the ingot mold which it carries, comes to rest with the spindles 21 in the forks 37, while the spindles 22 engage in the guides 23 of the section 26.

Obviously, it would also be possible, by disassembling the connecting rod 54 and by providing for appropriate slinging of the ingot mold casing 12 and/or of the supporting brackets 4, to withdraw only the ingot mold and its means of support and of guidance, leaving in place the upper member 20 which, in this event, would be resting separately on the structure 25 of the jacket.

It appears, however, that one of the essential advantages of the invention lies in the fact that, since the oscillation jacks rest directly on the ingot mold casing and on the frame of the upper cage 20, between which the force of separation of the ingot mold walls is actually applied, the unification of all the supporting and guiding members into a single assembly makes it possible to obtain a looping of the forces and consequenlty to lighten the weight of the connecting rods 42 and 44 which perform only a guiding function. Similarly, the articulations 41 and 43 are no longer subjected to considerable forces and may therefore be constructed more simply and made lighter.

The jacks 5 for controlling the oscillations of the ingot mold are preferably double-action jacks whose two chambers are connected to oil supply means 55 by means of flexible couplings 56 permitting the oscillating motions of the ingot mold.

Figure 3:
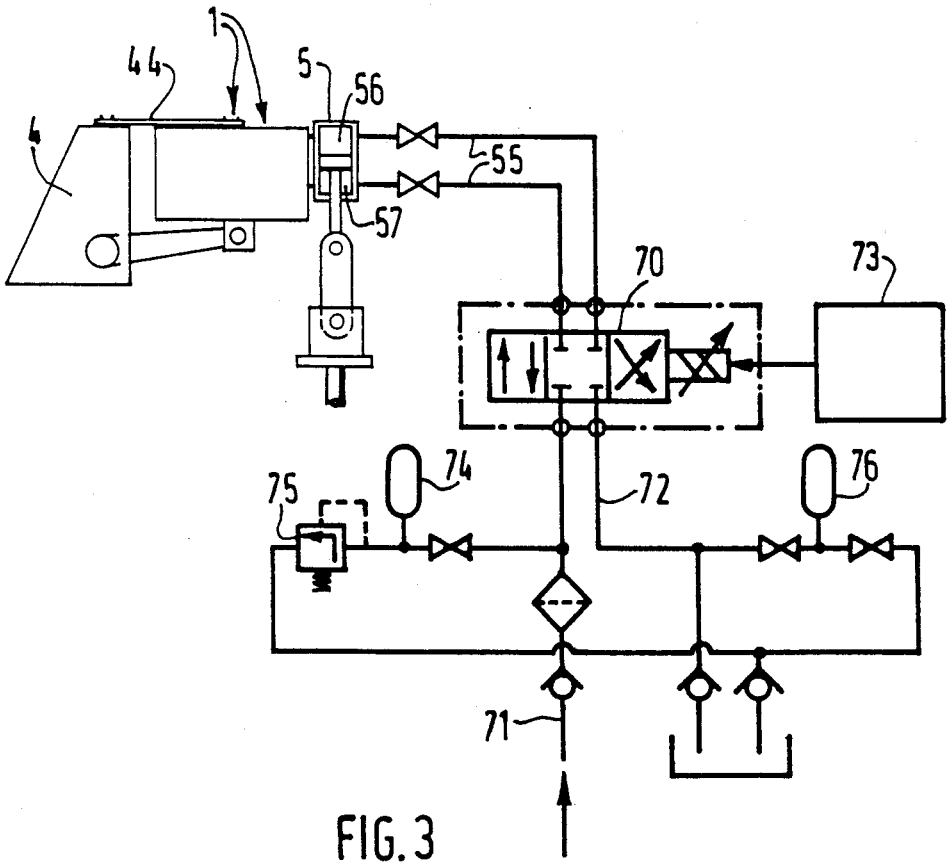
FIG. 3 is a hydraulic control diagram of the oscillating jack.

FIG. 3 shows, by way of example, a diagram of the hydraulic supply system 7 for the jacks 5.

Both chambers of the jack are connected by means of flexible couplings 56 to two outputs of a flow rate servo valve 70 whose inputs are connected, respectively, to supply circuits 71 and discharge 72 for fluid under pressure.

The flow rate servo valve 70, which is, for example, of the reverse mechanical feedback type, is actuated in a known manner by the action of an electrical signal supplied by a control device 73 and can assume three positions, corresponding to a neutral position in which the circuits are interrupted, and two supply positions, each for one of the chambers 57, 58 of the jack 5, the other chamber being then connected to the discharge circuit.

The supply circuit 71 is conventional and comprises, in particular, a pressure accumulator 74 which makes it possible to ensure a constant supply pressure, and a pressure limiter 75. The discharge circuit 72 is also connected to a pressure accumulator 76 which makes it possible, in particular, to ensure boosting of the circuits.

It will be appreciated that, by virtue of readily imaginable mechanical or electrical means, the control device 73 may control rapid motions of the servo valve 70 enabling the two chambers 57 and 58 of the jack 5 to be supplied alternately. It is thus very easily possible to modify, during operation, not only the frequency of oscillation but also the amplitude and the speed of movement, in order to choose the velocity/travel curve profile permitting the best adaptation to the gradations, formats and speeds of casting.

Furthermore, depending on the pressures employed, the jacks 5 may either be responsible only for the oscillation of the ingot mold, whose weight is then carried substantially by the flexible blades 44, or may also be used as a means of support for the ingot mold, the connecting rod 42 and the blade 44 being then used only for guiding along the casting axis.

Obviously, the oscillation could also be controlled by a single jack placed, in this case, in the median plane of symmetry of the ingot mold.

Figure 4:
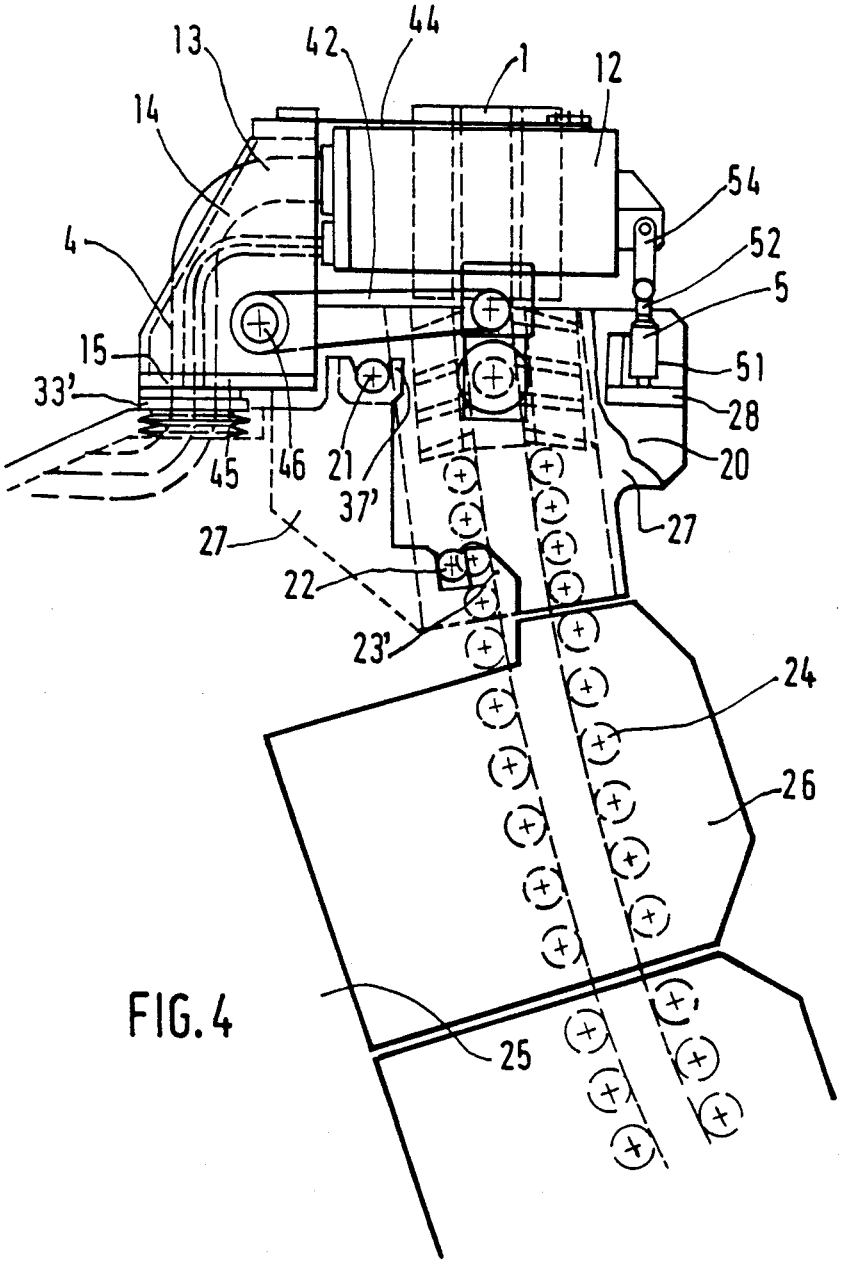
FIG. 4 is a side view of an improved plant.
Figure 5:
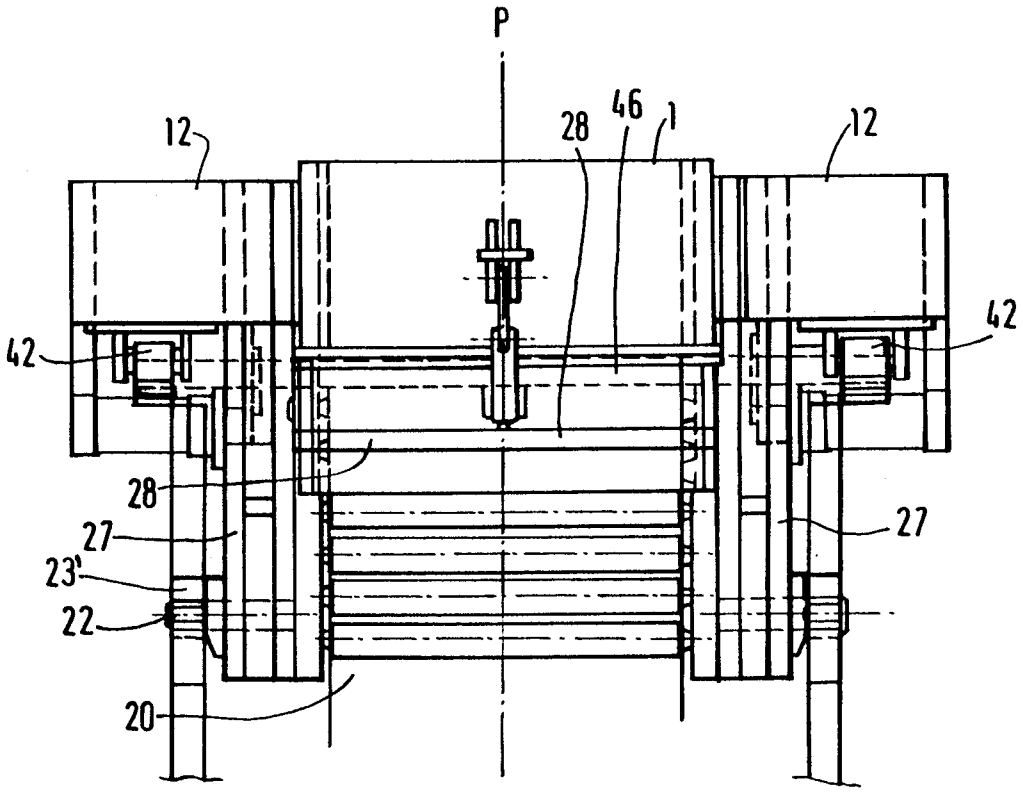
FIG. 5 is a front view of the plant shown in FIG. 4.

An arrangement of this kind has been illustrated by way of example in FIGS. 4 and 5, which shown another method of mounting the head of the machine on the frame of the roller apron.

The ingot mold 1 is guided, as just described, by a pair of connecting rods 42 associated with a pair of flexible blades 44 and articulated on two supporting brackets 4. However, the frame of the upper cage 20 of the roller apron rests by means of spindles 21 on forks 37' which are arranged in the upper part of the frame 25 of the roller apron, on which the others sections such as 26 are removably mounted. The frame 25 also carries, for example on an extended part, the slides 23' in which engage guiding spindles 22 placed in the lower part of the upper cage 20.

In this embodiment, the two brackets 4 supporting the connecting rods 42 and the flexible blades 44 are fastened rigidly to both sides 27 of the frame of the upper cage 20. The cooling fluid supply and discharge conduits 13 and 14 as well as, if desired, the jack 5 supply and discharge conduits end in couplings 15 which are fastened on a plate 45' placed on the lower part of one of the supporting brackets 4 and which is applied on a plate 33' at which the various circuits terminate. This connecting plate 33' is preferably mounted in a resilient manner on the upper part of the frame so as to be applied on the plate 45', to produce the leakproof connection of the various circuits, the support of the whole assembly on the supporting structure being provided, however, by the spindles 21 and 22.

In this embodiment, the means for controlling the oscillations consists of a single jack 5 placed in the median plane P (FIG. 5) of the ingot mold 1. In this case, the motions of the two connecting rods 42, 42', which are placed on each side of the casing 12, must be synchronized and, for this purpose, the two connecting rods are keyed on a torsion bar 46 which extends from one supporting bracket to the other on both sides of the median plane.

In the embodiment shown in FIGS. 4 and 5, the body of the jack 5 is fastened rigidly to the frame 20 of the upper element the rod of the jack being connected to the ingot mold casing 12 by a connecting rod 54 which is articulated at both its ends. In this case, the two sides 27 of the frame 20 of the upper element are connected by a crossbar 28 to which the body 51 of the jack is fastened.

This arrangement offers the advantage of enabling the jack 5 to be supplied by means of rigid circuits fastened to one of the sides 27 of the upper element and terminating at the connection plate 45'. However, the jack 5 is then more difficult to protect against splashing by steel which may occur in the event of a breakout at the exit of the ingot mold. On the other hand, the jack is better protected against steel splashes when it is fastened directly to the ingot mold casing 12, as in the case of FIGS. 1 and 2, but it must then be supplied by means of flexible lines either from the working deck 31 or from the connection plate 45'.

It can be seen that the arrangements according to the invention offer many adavantages, especially because of the fact that all the oscillation and guidance means are integrated with the assembly consisting of the ingot mold and the cage, and couplings to the machine may be reduced to two hook-up points per side, with the result that adjustment is greatly simplified and easy to control.

In conventional solutions, on the other hand, the ingot mold is connected, on the one hand, to the supporting frame for the oscillation devices and, on the other hand, to the upper cage, and each of these members must be positioned on the supporting framework or structure by means of at least two points per side, which increases the number of adjustments. However, the machine head according to the invention forms a compact unit which is light in weight and is relatively independent of the remaining parts of the machine.

In addition, the forces involved are lower than in conventional structures, both in respect of dead weights and in respect of frictional forces, which are for the most part contained between the ingot mold and the upper cage. Furthermore, the hydraulic jacks employed for controlling the oscillations of the ingot mold and which are placed between the ingot mold and the upper cage are more accessible and better protected than in the usual arrangements where the mechanism controlling the oscillations is placed below the deck, near the roller apron as such. i.e. in a region which is wet and dirty and exposd to high temperatures.

An oscillation guiding system employing connecting rods or flexible blades has been described, but the invention would be equally capable of being used in the case of guidance a slide or using roller wheels.

Similarly, it would be possible to arrange for the weight of the ingot mold to be carried on the upper cage using springs, to reduce the forces applied to the means for controlling oscillations. Furthermore, the latter could be determined by means other than a hydraulic jack, for example by an electrical device, comprising a linear motor, a coil with a solenoid plunger or any other electromechanical system of low bulk.

What is claimed is:

1. A continuous metal casting plant comprising (a) an ingot mold and a secondary cooling device aligned along a casting axis and mounted on a supporting structure;

(b) means for supporting and guiding said ingot mold along said casting axis;

(c) means for controlling oscillations of said ingot mold parallel to said casting axis;

(d) said ingot mold comprising a set of cooled walls defining a bottomless casting cavity and carried by a frame-shaped casing;

(e) said secondary cooling device comprising an assembly of devices for guiding and cooling a cast product, said assembly being mounted on a supporting frame and defining a roller apron extending along said casting axis between an upper part placed immediately downstream of an exit of the casting cavity and a lower part opening out into an extraction device;

(f) said means for controlling the oscillations of said ingot mold resting directly, on one side, on the ingot mold casing and, on the other side, on the upper part of the supporting frame of said roller apron.

2. A continuous metal casting plant comprising (a) an ingot mold a secondary cooling device aligned along a casting axis and mounted on a supporting structure;

(b) means for supporting and guiding said ingot mold along said casting axis;

(c) means for controlling oscillations of said ingot mold parallel to said casting axis;

(d) said ingot mold comprising a set of cooled walls defining a bottomless casting cavity and carried by a frame-shaped casing;

(e) said secondary cooling device comprising an assembly of devices for guiding and cooling a cast product, said assembly being mounted on a supporting frame and defining a roller apron extending along said casting axis between an upper part placed immediately downstream of an exit of the casting cavity and a lower part opening out into an extraction device;

(f) said upper part of said roller apron consisting of a separate member forming an upper cage, capable of being removed with the ingot mold from a remainder of the plant;

(g) said means for controlling the oscillations of said ingot mold being fastened, on one side, on the ingot mold casing and, on the other side, on a frame of said upper cage.

3. The continuous casting plant as claimed in claim 1 and 2, wherein the means (5) for controlling the oscillations and the upper cage (20) also form the means for supporting the ingot mold (1).

4. A continuous metal casting plant comprising (a) a supporting structure;

(b) an ingot mold consisting of a set of cooled walls defining a bottomless cavity and carried by a frame-shaped casing;

(c) means for supporting said ingot mold;

(d) means for guiding said ingot mold along a casting axis;

(e) means for controlling oscillations of said ingot mold parallel to said casting axis;

(f) a secondary cooling device comprising an assembly of devices for guiding and cooling a cast product, said assembly being mounted on a supporting frame and defining a roller apron extending along said casting axis between an upper part placed immediately downstream of an exit of the casting cavity and a lower part opening out into an extraction device;

(g) said upper part of said roller apron consisting of a separate member forming an upper cage capable of being removed with the ingot mold from a remainder of the plant;

(h) said means for controlling the oscillations of said ingot mold being fastened, on one side, on the ingot mold casing and, on the other side, on a frame of said upper cage and constituting with said upper cage said means for supporting the ingot mold;

(i) said means for guiding the ingot mold being mounted on a frame fastened to the frame of said upper cage, (j) said ingot mold constituting with said upper cage and said means for supporting, guiding and controlling the oscillations of the ingot mold, an assembly capable of being removed and placed back in position as a unit on which the alingment and oscillation adjustments may be performed outside the plant.

5. The continuous casting plant as claimed in any one of claims 1 to 4, wherein the means (5) for controlling the oscillations consists of at least one device (5) comprising two members (51,52) capable of travelling relative to each other and in one or other direction along a direction which is substantially parallel to the casting axis, one of said members being fastened to the ingot mold casing (12) and the other to the frame (27) of the upper part (20) of the roller apron.

6. The continuous casting plant as claimed in claim 5, wherein the means for controlling the oscillations is a hydraulic jack (5) comprising a body (51) and a plunger (52) which are connected by at least two aritculated connections (54) to the ingot mold frame (12) and to the frame (27) of the upper part of the guiding jacket, respectively.

7. The continuous casting plant as claimed in claim 6, wherein the body (51) of the jack (5) is fastened rigidly to the ingot mold casing (12) and the plunger (52) is connected by a coupling (54) comprising two articulations to the frame (27) of the upper element (20) of the roller apron, the jack being connected by flexible couplings to supply and discharge circuits fastened to the frame of the upper member.

8. The continuous casting plant as claimed in claim 6, wherein the body (51) of the jack is fastened rigidly to the frame (27) of the upper element (20) of the jacket and the plunger (52) is connected by a coupling (54) comprising two articulations to the ingot mold box (12), the jack being connected to supply and discharge conduits which are fastened rigidly to the frame (27) of the upper element (20).

9. The continuous casting plant as claimed in claim 6, wherein the hydraulic jack (5) is a double-action jack and is connected to a system (7) for alternate supply to the two chambers provided by the plunger.

10. The continuous casting plant as claimed in any one of claims 1 to 4, wherein the means for guiding the oscillations consists, on each side of the ingot mold, of two elongated members (42,44) of fixed length which are substantially parallel and connected at their ends to two points placed at different levels, on one side on the ingot mold casing (12) and on the other side on a supporting bracket (4), respectively.

11. The continuous casting plant as claimed in claim 10, wherein at least one of the guiding members is a connecting rod (42) articulated at its two ends to the ingot mold casing (12) and to a supporting bracket (4), respectively.

12. The continuous casting plant as claimed in claim 10, wherein at least one of the guiding members is a flexible blade (44) fastened at its two ends to the ingot mold frame (12) and to the supporting bracket (4), respectively.

13. The continuous casting plant as claimed in claim 10, wherein the supporting brackets (4) of the guiding members are fastened on the corresponding two sides (27) of the frame of the upper element (20) of the roller apron.

14. The continuous casting plant as claimed in claim 13, wherein each of the supporting brackets (4) is mounted on a support plate (45) capable of being fastened ridigly on a corresponding platform (33) provided on the supporting structure (3) of the plant.

15. The continuous casting plant as claimed in claim 2 or 4, wherein the frame of the upper element (20) of the roller apron is connected on two opposing sides (27) to the supporting structure (3,32) of the plant by means of four removable resting points (21,22) placed in pairs on each of the opposing sides and on two offset levels.

16. The continuous casting plant as claimed in claim 15, wherein two resting points placed at the same level on two opposing sides (27) of the frame of the upper member (20) consist of two spindles (21) aligned along an axis at right angles to the casting axis and resting on supporting parts (37) in the shape of a fork which is open upwards, which are provided on the supporting structure (3,32), and wherein the other two resting points consist of devices (22,23) for guidance with the possibility of sliding along a direction parallel to the casting axis.

17. The continuous casting plant as claimed in claim 16, wherein the devices (22,23) for guidance in parallel to the casting axis are interposed between the lower part of the upper element (20) of the roller apron and the upper part of the following member (26) of the roller apron.

18. The continuous casting plant as claimed in claim 7 or 8, comprising conduits (13,14) for supplying and discharging fluids are connected, respectively, to automatic coupling terminals (15) placed on at least one plate (45) fastened integrally to a supporting bracket (4) and engaging in a removable and leakproof manner in corresponding terminals placed on a connecting plate (33') capable of being resiliently applied on the said plate (45).

19. The continuous casting plant as claimed in claim 6, wherein the jack (5) for controlling the oscillations of the ingot mold is fed by an hydraulic circuit (7) comprising means for regulating the amplitude velocity and frequency of the oscillations, permitting adaptation to the formats and speeds of casting.

20. The continuous casting plant as claimed in claim 11, wherein the means (5) for controlling the oscillations is a single device placed in the median plane of the ingot mold and wherein the two connecting rods (42) for guiding the ingot mold are integrally connected by a torsion bar (46).

* * * * *